US009516920B1

(12) United States Patent
DeRose

(10) Patent No.: US 9,516,920 B1
(45) Date of Patent: Dec. 13, 2016

(54) FOOTWEAR STRUCTURE

(71) Applicant: Joseph A. DeRose, Scottsdale, AZ (US)

(72) Inventor: Joseph A. DeRose, Scottsdale, AZ (US)

( * ) Notice: Subject to any disclaimer, the term of this patent is extended or adjusted under 35 U.S.C. 154(b) by 581 days.

(21) Appl. No.: 14/034,790

(22) Filed: Sep. 24, 2013

Related U.S. Application Data

(60) Provisional application No. 61/705,500, filed on Sep. 25, 2012, provisional application No. 61/817,540, filed on Apr. 30, 2013.

(51) Int. Cl.
*A43C 11/00* (2006.01)
*A43C 11/14* (2006.01)
*A43B 3/26* (2006.01)

(52) U.S. Cl.
CPC ..... *A43C 11/00* (2013.01); *A43B 3/26* (2013.01); *A43C 11/008* (2013.01); *A43C 11/1493* (2013.01)

(58) Field of Classification Search
CPC ..... A43C 11/00; A43C 11/002; A43C 11/006; A43C 11/008; A43C 11/1493; A43B 3/26
USPC ..... 36/97, 105, 50.1, 138
See application file for complete search history.

(56) References Cited

U.S. PATENT DOCUMENTS

| | | | | |
|---|---|---|---|---|
| 75,048 | A * | 3/1868 | Perley | A43B 23/26 36/138 |
| 537,627 | A * | 4/1895 | Bixby et al. | A43B 3/101 36/50.1 |
| 797,966 | A * | 8/1905 | Lange et al. | A43B 3/101 36/8.2 |
| 2,523,449 | A * | 9/1950 | Rosenzweig | A43B 3/26 36/102 |
| 3,142,911 | A * | 8/1964 | Raborg | A43B 3/26 36/105 |
| 4,136,468 | A * | 1/1979 | Munschy | A43B 3/26 36/97 |
| 6,295,743 | B1 * | 10/2001 | Brooks | A43B 7/20 36/105 |

FOREIGN PATENT DOCUMENTS

| | | | | |
|---|---|---|---|---|
| CH | FR 2516762 | A1 * | 5/1983 | A43C 11/1493 |

* cited by examiner

*Primary Examiner* — Ted Kavanaugh
(74) *Attorney, Agent, or Firm* — Cahill Glazer PLC

(57) ABSTRACT

A footwear structure comprising a shoe having sidewalls and including gaps provided in the sidewalls extending from the sole and positioned on either side of the footwear in alignment with the medial and lateral malleoli; closure systems are provided to partially close the gaps for applying a selected force to the wearer's foot through internal pads bridging the respective gap and contacting the wearer's foot.

7 Claims, 3 Drawing Sheets

FOOTWEAR STRUCTURE

RELATED APPLICATIONS

This application is related to and claims priority to a provisional application entitled "FOOTWEAR STRUCTURE" filed Sep. 25, 2012, and assigned Ser. No. 61/705,500, and a provisional application entitled "FOOTWEAR STRUCTURE AND METHOD" filed Apr. 30, 2013, and assigned Ser. No. 61/817,540.

FIELD OF THE INVENTION

The present invention relates to footwear, such as shoes, wherein adjustments are provided to permit selective pressure to be applied to the inside or outside of the wearer's foot.

BACKGROUND OF THE INVENTION

The present invention is directed to a footwear structure for assisting in the support and/or correction of the positioning of a wearer's foot including the application of force to compensate for weaknesses or structural deficiencies in the positioning and alignment of the wearer's foot. Typically an orthotic may be prescribed to be used in a conventional shoe to correct or otherwise support proper positioning and alignment of a wearer's foot. Frequently, the orthotic is not sufficient to apply the necessary forces to assist the wearer's foot to assume a correct alignment and provide the appropriate positioning of the subtalar and malleoli. Further, when enduring certain strenuous activities such as running, soccer or other athletic events, the stresses imposed may suggest the implementation of supporting forces applied to the foot to prevent injury. The imposition of forces as a result of strenuous athletic activity may also suggest the addition of supporting forces during pronation and supination of the subtalar joint when subjected to violent activity-induced forces. The present invention is directed to a footwear structure that is directed to the creation of forces to help support the ankle and avoid injury that may otherwise result from such violent activity.

BRIEF DESCRIPTION OF THE DRAWINGS

The present invention may more readily be described by reference to the accompanying drawings in which.

DETAILED DESCRIPTION OF THE INVENTION

Figure 1:
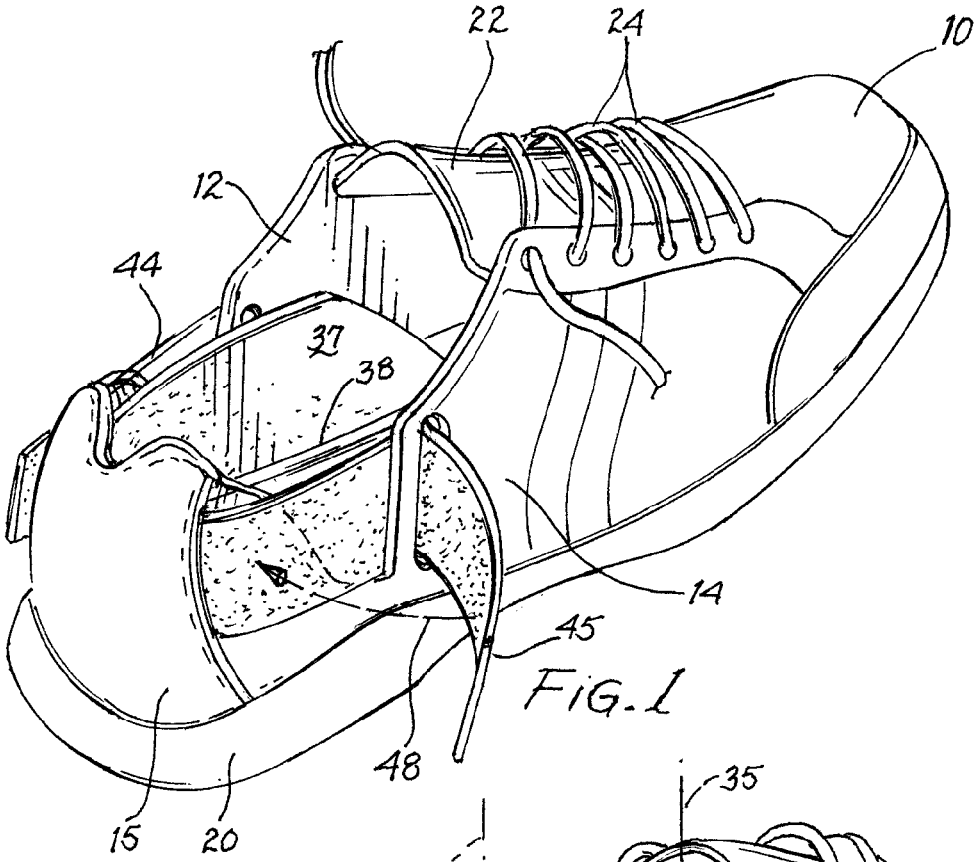
FIG. 1 is a three-quarter perspective view of a footwear structure incorporating the teachings of the present invention and utilizing flexible straps as a closure system.
Figure 2:
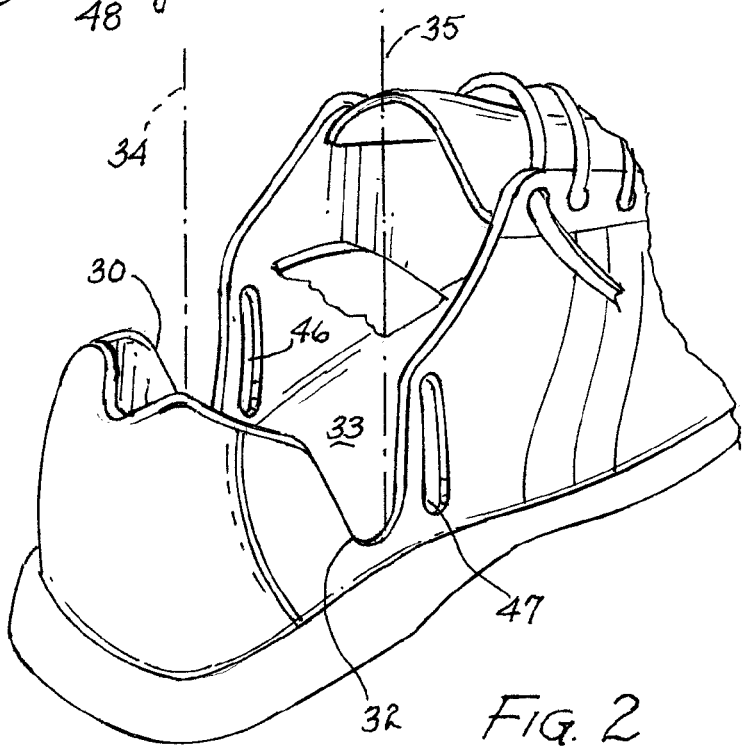
FIG. 2 is a partial perspective view of the footwear structure of FIG. 1 with the flexible straps removed to more clearly show the respective gaps and corresponding slots.

Referring to FIGS. 1 and 2, an illustration of a footwear structure comprising a shoe incorporating the teachings of the present invention is shown. The shoe includes a conventional toe box 10 connected through medial or inner sidewall 12 and lateral or outer sidewall 14, to a heel cap 15. A conventional sole 18 including a heel 20 is provided and the shoe chosen for illustration may include well known tongue 22 and a shoelace 24 closure system. The present invention improves upon the structure to provide a selective variable adjustment to apply pressure medially or laterally to support the foot and affect the stability of the foot and ankle. The sidewalls 12, 14 are provided with a medial sidewall gap 30 and a lateral sidewall gap 32. Each of the gaps extend upwardly from near the insole 33 and, in the embodiment chosen for illustration, form gaps each having a vertically extended center line 34, 35 aligned with the wearer's medial malleoli and lateral malleoli, respectively. Each of the gaps 30, 32 is provided with an internal pad extending across or bridging the respective gap. In the embodiment chosen for illustration a first internal pad 37 bridges the medial gap 30 and a second internal pad 38 bridges the lateral gap 32. Each of the pads is secured to the inner surface of the sidewall adjacent one side of the respective gap and is therefore free to move with respect to an opposite side of the respective gap. Alternatively, the internal pads could be attached to the insole or the midsole of the shoe and thus be free to move relative to each of the adjacent sidewall surfaces and remain stationary with respect to the wearer's foot as the respective gaps are adjusted. The bottom of each of the gaps is positioned near the insole 33; the gaps may extend entirely to the insole or may be positioned slightly above as shown in the drawings. The depth of the respective gaps is selected to permit their adjustable closure; the portion of the sidewall located below the gaps is selected to be of insufficient height to interfere with the adjustable closure of the respective gap.

An adjustable closure means is connected to the sides of each of the gaps to permit adjustable partial closing of the respective gaps and to apply appropriate pressure through the respective internal pad to the foot. The pressure or force on the foot and/or ankle provides medial or lateral support to the wearer's foot. It may be noted that the selective force applied by the corresponding internal pad may provide support or corrective action in combination with an orthotic placed within a shoe and designed for use for specific corrective action with regard to the wearer's foot.

Each of the sidewall gaps is provided with an adjustable closure system to permit selective pressure to be applied medially or laterally to help support the foot and ankle—and if correction is required, assist in the corrective positioning and application of force to the foot and ankle. When the shoe is intended for athletic use, the respective medial and/or lateral force may be adjusted to correspond to the specific event in which the wearing athlete is participating.

The adjustable closure system for the respective gaps may take any of several forms. In the preferred embodiment shown in FIGS. 1, 2 and 3, the adjustable closure system comprises a pair of flexible straps 44 and 45 each secured at one end to a side of the corresponding gap and each extending across the gap to be threaded through a slot 46 and 47, respectively, on an opposite side of the corresponding gap. Each of the straps is provided with a hook and loop surface so that the strap may be threaded through the corresponding slot and folded back upon itself as indicated by the arrow 48 to thereby become releasably secured. When the hook and loop surfaces come in contact, the strap is firmly positioned and held in place with a tension determined by the wearer after threading the corresponding strap through its respective slot. Referring to FIG. 2, the flexible straps have been removed to more clearly show the corresponding slots 46 and 47 each positioned for receiving a strap to be threaded therethrough and folded back upon itself as indicated above in connection with FIG. 1.

The internal pads 37 and 38 may contact the wearer's foot or, in those instances when the shoe is formed as a brace shoe, the pads will contact the brace. In either case, the force applied through the pad to the wearer's foot or brace will provide support in a predetermined manner and adjustable with respect to the medial and lateral malleoli. As indicated above, the variable forces provided by the pads can be to support a wearer's normal foot, or to assist in corrective action to compensate for needed force or positioning of the wearer's foot. Further, the corrective action can be coupled with a prescribed orthotic that may be positioned within the shoe.

Figure 3:
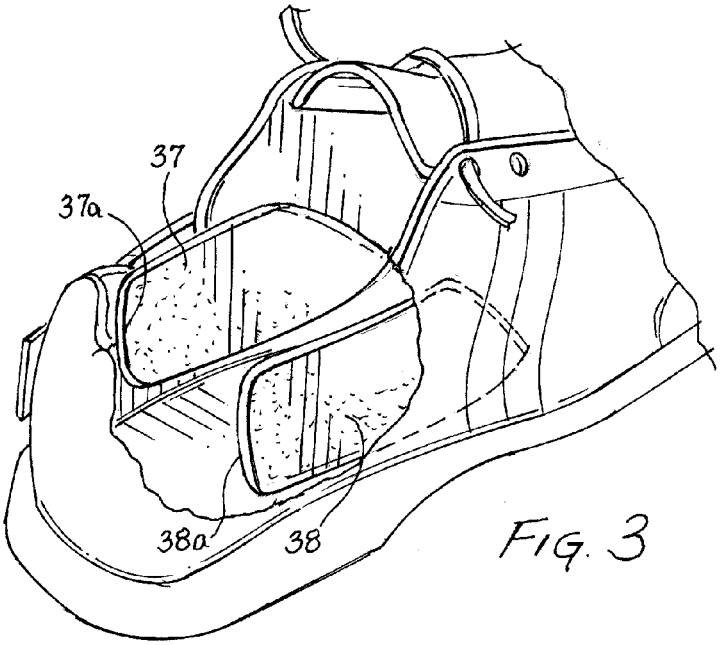
FIG. 3 is a partial perspective view of the footwear structure of FIG. 1, partially broken away, to more clearly show the corresponding pads positioned within the shoe.

Referring to FIG. 3, a partial view of the embodiment of FIG. 1 is shown having portions of the shoe broken away to more clearly reveal the internal pads 37 and 38. It may be seen that the pads are secured, such as by stitching, at the forward portion of the pad, to the sidewall of the shoe. The internal pads extend rearwardly toward the heel and cover the corresponding gap. The ends 37*a* and 38*a* of the pads 37 and 38, respectively, are unattached and are therefore free to move longitudinally within the shoe as the gaps are adjusted. As the respective gaps are closed through utilization of the above described closure system, the ends 37*a* and 38*a* of the pads are free to move longitudinally within the shoe while the gap is being adjusted. The pads may be provided with a padded internal surface for contacting the wearer's foot to provide comfort and to prevent chafing. As the respective closures of the gaps are adjusted, forces are applied by the corresponding pads to the wearer's foot.

Figure 4:
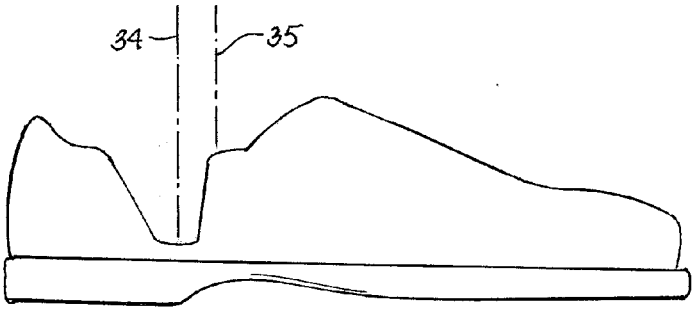
FIG. 4 is a schematic side elevational view of the footwear structure showing the positioning of corresponding gaps and their center lines.
Figure 5:
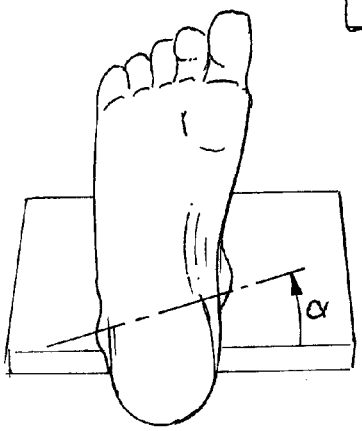
FIG. 5 is an illustration of the bottom of a foot useful for describing the positioning of the respective gaps in the footwear structure of the present invention.

Referring to FIG. 4, a side elevation schematic illustration is provided indicating the center lines 34 and 35 of the respective gaps. It may be noted that the medial gap 34 and lateral gap 35 are each aligned with a corresponding malleolus and therefore are not directly opposite one another when viewed in side elevation as shown in FIG. 4. The sidewall gaps 30 and 32 may take several forms such as rectangular, V-shaped or other irregular form. Some forms may not have a clearly defined centerline but the general center of the opening provided by the gap should be aligned with the respective malleoli. Referring to FIG. 5, a bottom view of a normal foot is illustrated indicating the external malleolar torsion a of 13° to 18° present in the normal adult when the knee joint is extended and the subtalar joint is in the neutral position. This torsion a results in the normal position of the medial and lateral malleoli which, in turn, results in the positioning of the respective gaps and the corresponding positioning of the respective center lines of the gaps 34 and 35 as shown in FIG. 4.

Figure 6:
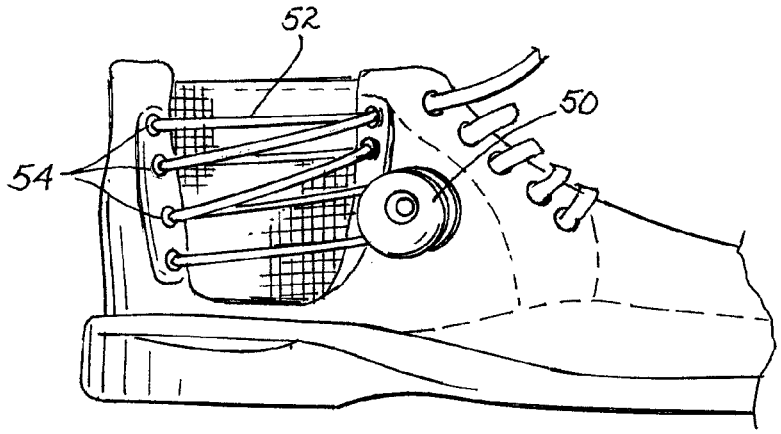
FIG. 6 is a side elevational view of an alternative closure system for use in the footwear structure of the present invention.
Figure 7:
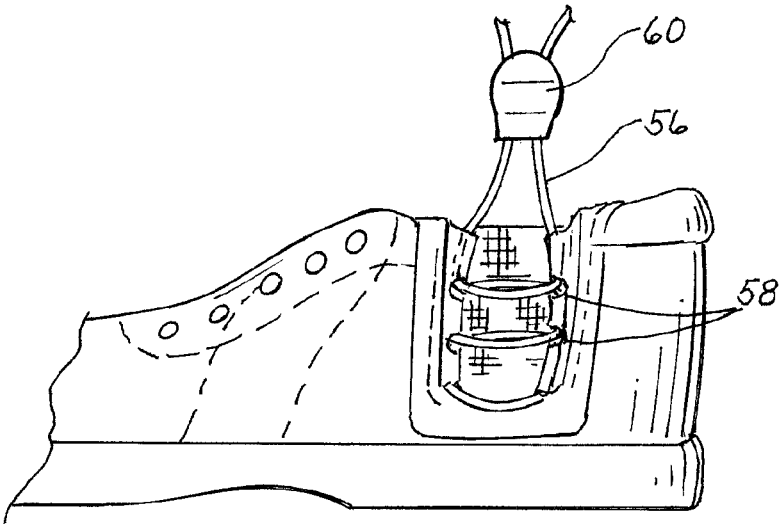
FIG. 7 is a partial side elevational view of another alternative closure system for use in the footwear structure of the present invention.

An alternative closure system for the respective gaps may incorporate a wire and reel-based system such as that available from Boa Technologies Inc. Referring to FIG. 6, a locking reel 50 is positioned conveniently at the sidewall of the shoe and is wound with cord or wire 52 that extends from the reel through a plurality of eyelets 54. As the reel is rotated, tension is applied through the wire 52 and corresponding eyelets 54 to provide a closure force to the corresponding gap. Another alternative closure system is shown in FIG. 7 wherein conventional lacing 56 is threaded through eyelets or loops 58 and may be drawn tight to force the partial closure of the corresponding gap. The lacing may be locked in place using conventional shoelace tying techniques or using a well known sliding locking fixture 60.

The shoe may be designed as a high top shoe to permit adjustable closure on the medial and lateral sides of the shoe to apply forces above the axis of the subtalar joint to assist in the control of movement over that joint to control either lateral instability or medial instability and provide another form of an ankle-foot orthosis. Again, this corrective force provided by the closure of the lateral and medial gaps could be in addition to and supportive of other systems such as an orthotic within the shoe.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A footwear structure for a wearer's foot comprising:

(a) a shoe having a toe box, a heel cap, an inner or medial sidewall and an outer or lateral sidewall connecting the toe and heel cap, and having an insole and a midsole;

(b) a first gap in the medial sidewall extending upwardly from the insole and adapted to be aligned with the wearer's medial malleolus;

(c) a second gap in the lateral sidewall extending upwardly from the insole and adapted to be aligned with a wearer's lateral malleolus; wherein the first gap is positioned, in a longitudinal direction of the shoe, forward of the second gap;

(d) The position of the first and second gaps adapted to provide an external malleolar torsion of from 13° to 18°;

(e) a first adjustable closure system mounted on said sidewall for adjustably closing said first gap; and (f) a second adjustable closure system mounted on said sidewall for adjustably closing said second gap.

2. The footwear structure of claim 1 wherein said first adjustable closure system comprises a first flexible strap extending across said first gap and having an end thereof attached to one side of said first gap and releasably secured at an opposite end thereof to a side of said first gap; and wherein said second adjustable closure system comprises a second flexible strap extending across said second gap and having one end thereof attached to one side of said second gap and releasably secured at an opposite end thereof to a side of said second gap.

3. The footwear structure of claim 2 wherein said first flexible strap is attached at one end thereof to one side of said first gap and releasably secured at an opposite end thereof to said one side of said first gap; and wherein said second flexible strap is attached at one end thereof to one side of said second gap and releasably secured at an opposite end thereof to said one side of said second gap.

4. A footwear structure for a wearer's foot comprising:

(a) a shoe having a toe box, a heel cap, an inner or medial sidewall and an outer or lateral sidewall connecting the toe and heel cap, and having an insole and a midsole;

(b) a first gap in the medial sidewall extending upwardly from the insole and adapted to be aligned with a wearer's medial malleolus;

(c) a second gap in the lateral sidewall extending upwardly from the insole and adapted to be aligned with a wearer's lateral malleolus; wherein the first gap is positioned, in a longitudinal direction of the shoe, forward of the second gap;

(d) the position of the first and second gaps adapted to provide an external malleolar torsion of from 13° to 18°;

(e) a first adjustable closure system mounted on said sidewall for adjustably closing said first gap;

(f) a second adjustable closure system mounted on said sidewall for adjustably closing said second gap;

(g) a first pad mounted in said shoe extending across said first gap for contacting the wearer's foot and transmitting force thereto; and (h) a second pad mounted in said shoe extending across said second gap for contacting the wearer's foot and transforming force thereto.

5. The footwear structure of claim 4 wherein said first adjustable closure system comprises a first flexible strap extending across said first gap and having an end thereof attached to one side of said first gap and releasably secured at an opposite end thereof to a side of said first gap, and wherein said second adjustable closure system comprises a second flexible strap extending across said second gap and having one end thereof attached to one side of said second gap and releasably secured at an opposite end thereof to a side of said second gap.

6. The footwear structure of claim 4 wherein said first and second flexible straps are attached at one end thereof to one side of said first and second gaps, respectively, and each is releasably secured at an opposite end thereof to said one side of said first gap and second gap, respectively.

7. The footwear structure of claim 4 wherein said first pad is secured to said medial sidewall and extends across said first gap; and said second pad is secured to said lateral sidewall and extends across said second gap.

* * * * *